United States Patent [19]

Bender

[11] Patent Number: 5,018,350

[45] Date of Patent: May 28, 1991

[54] LONG STROKE DEEP WELL PUMPING UNIT

[76] Inventor: E. A. Bender, 6625 Kane Way, Bakersfield, Calif. 93309

[21] Appl. No.: 521,332

[22] Filed: May 9, 1990

[51] Int. Cl.[5] ..... F16D 31/02

[52] U.S. Cl. ..... 60/369; 60/371; 417/400; 74/89.22; 74/110; 92/117 A; 92/137

[58] Field of Search ..... 60/371, 369, 372; 417/400, 401, 402, 403, 404; 74/110, 89.22; 92/117 A, 137

[56] References Cited

U.S. PATENT DOCUMENTS

| | | | |
|---|---|---|---|
| 3,248,958 | 5/1966 | Bender | 74/89.20 |
| 3,345,950 | 10/1967 | Bender | 103/206 |
| 3,483,828 | 12/1969 | Bender . | |
| 3,538,777 | 11/1970 | Bender | 74/37 |
| 4,187,680 | 2/1980 | Sanford | 60/371 X |
| 4,391,155 | 7/1983 | Bender | 74/89.2 |
| 4,430,924 | 2/1984 | Dunn | 60/369 X |
| 4,496,285 | 1/1985 | Albert et al. | 417/12 |
| 4,497,616 | 2/1985 | Ratell | 60/369 X |
| 4,651,582 | 3/1987 | Bender | 74/89.22 |
| 4,872,360 | 10/1989 | Lew | 92/117 A X |

*Primary Examiner*—John T. Kwon
*Assistant Examiner*—Todd Mattingly
*Attorney, Agent, or Firm*—Dennis B. Haase

[57] ABSTRACT

A long stroke deep well pumping unit which employs a fluid motor connected with a polish rod by using a plurality of belts, fixed at either end, to reciprocate the sucker rod through repeated long strokes with a minimum of stress and shock to the sucker rod during directional change.

7 Claims, 3 Drawing Sheets

LONG STROKE DEEP WELL PUMPING UNIT

BACKGROUND OF THE INVENTION

1. Field of the Invention

The present invention relates to crude oil pumping from deep wells with emphasis on long stroke pumping apparatus employing counterbalancing, or counterweighting, for improved efficiency.

Apparatus of the type to which the present invention pertains is in wide-spread usage wherever retrieval of crude oil from deep wells, some of which are 16,000 feet or more, is required. Inherent in deep well pumping is the requirement for an extremely long string of rods, fastened end to end, to extend from a pump down into the well to a depth somewhat below the current crude oil level in the well. Because of the length of these rods, often referred to, collectively, as a sucker rod, relative to its diameter, they have a tendency to stretch when in tension, and upon reversal of the pumping stroke, the shock of the change in direction often results in damage, if not destruction, of the rod somewhere along its length. Needless to say, retrieval of a damaged or broken rod below the earth's surface is a complex and time consuming problem and, therefore, a very expensive problem.

2. Overview Of The Prior Art

In order to alleviate problems inherent in deep well pumping, I, as well as others, have, for several years, sought various means of minimizing damage to sucker rods while providing a smooth, even stroke for delivery of an optimum quantity of oil with a minimum of energy expense. Examples of these previous efforts include my previously issued patents, U.S. Pat. Nos. 3,248,958; 3,345,950; 3,483,828; 4,391,155; 4,651,582, and this current effort. Others who have recognized the value of using elastic belts include Albert, et al. U.S. Pat. No. 4,496,285.

SUMMARY OF THE INVENTION

The present invention has, as one of its principal objectives, the provision of counterbalanced deep well pumping apparatus which minimizes damage to the sucker rod through the use of inherent absorbent abilities via the belts, which permits enhanced control of shock and stress to the sucker rod during stroke reversal.

Whereas a 16 foot stroke has become somewhat of an industry standard, it is another objective of the present invention to provide a long stroke of the sucker rod with a lesser movement of the reciprocating motor, thereby accomplishing the same or more work with significantly less effort.

As a adjunct to the previously outlined objectives, it is a further objective to provide a low maintenance system which will continue to function under adverse oilfield conditions, which include wind, heat, and blowing dust and sand.

In accomplishing these objectives, the system employs a hydraulic motor as its source of motive power. Unlike conventional reciprocating piston within a cylinder systems, however, the present invention uses the piston as a reaction member to reciprocate the cylinder in a fashion which maintains the cylinder in tension at all times, effectively pulling it first in one direction and then the other. In accordance with the invention, the cylinder is an integral part of a counterweight, or counterbalance, system which engages high tensile strength elastic belts, anchored at one end to the tower of the unit, and attached at the other end to the polish rod. By configuring the belt in the manner of the present invention, use of a mechanical advantage is gained to reduce fluid pressures which might otherwise be required to do the same work.

As will be seen in the description of the preferred embodiment, the simplicity of the system lends itself to extended operation with minimal maintenance.

DESCRIPTION OF THE DRAWING

The present invention is depicted in the drawings, wherein.

DESCRIPTION OF A PREFERRED EMBODIMENT

Figure 1:
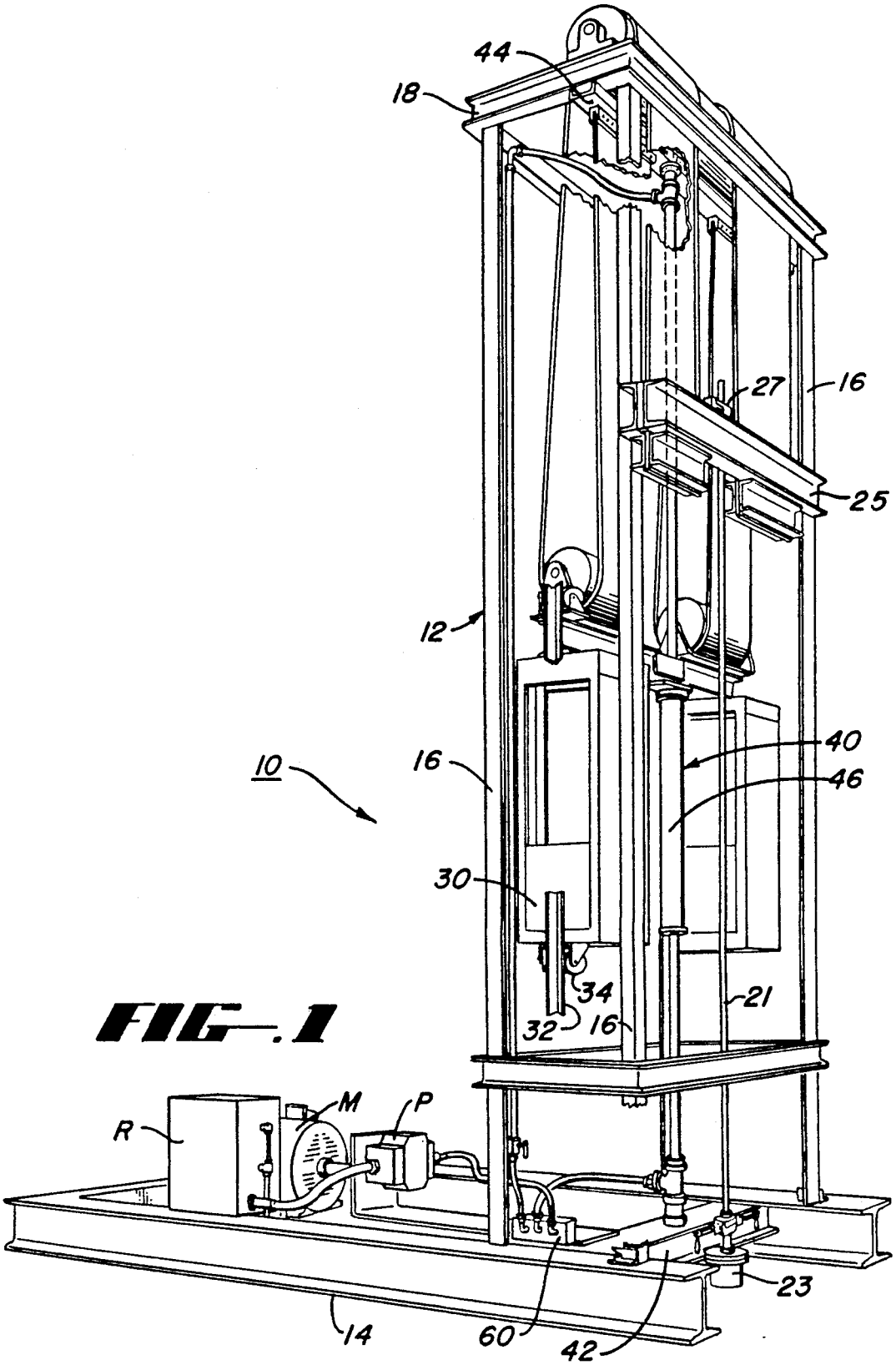
FIG. 1 is a side elevation of the pumping unit of the present invention, shown in perspective with some portions cut away to illustrate specific parts of the unit.

With reference now to the drawings, and initially focusing on FIG. 1, a long stroke deep well pumping unit is illustrated at 10. The pumping unit comprises a framework which defines a tower 12, supported by a base 14 from which vertically disposed frame members 16 extend. In order to provide rigidity, the frame members are tied together by cross members 18 at the top, and along several intermediate stations from top to bottom of the framework.

A polish rod 21 protrudes from a well head 23, located immediately adjacent to the front of the tower 12. The polish rod, which is connected to a sucker rod, not shown, in the well, extends upwardly where it is clamped into, and held by, a polish rod carrier 25 by means of a clamping device 27.

In keeping with one aspect of the invention, counterweight apparatus 30 is disposed in the space defined by the frame members 16. The counterweight apparatus may take the form of a tank into which gravel and water may be placed, or it may, if desired, provide a carriage into which metal bars or the like may be placed in order to permit appropriate weight adjustment. Parallel, vertically disposed tracks or guides 32 are supported by the framework, and, as illustrated, takes the form of an angle iron. The frame of the counterweight apparatus is fixed with wheels, or cam followers, 34, which engage and ride on the track to thereby control the position of the counterweight apparatus within the frame, while permitting it to reciprocate within the frame, as will be hereinafter described.

Figure 3:
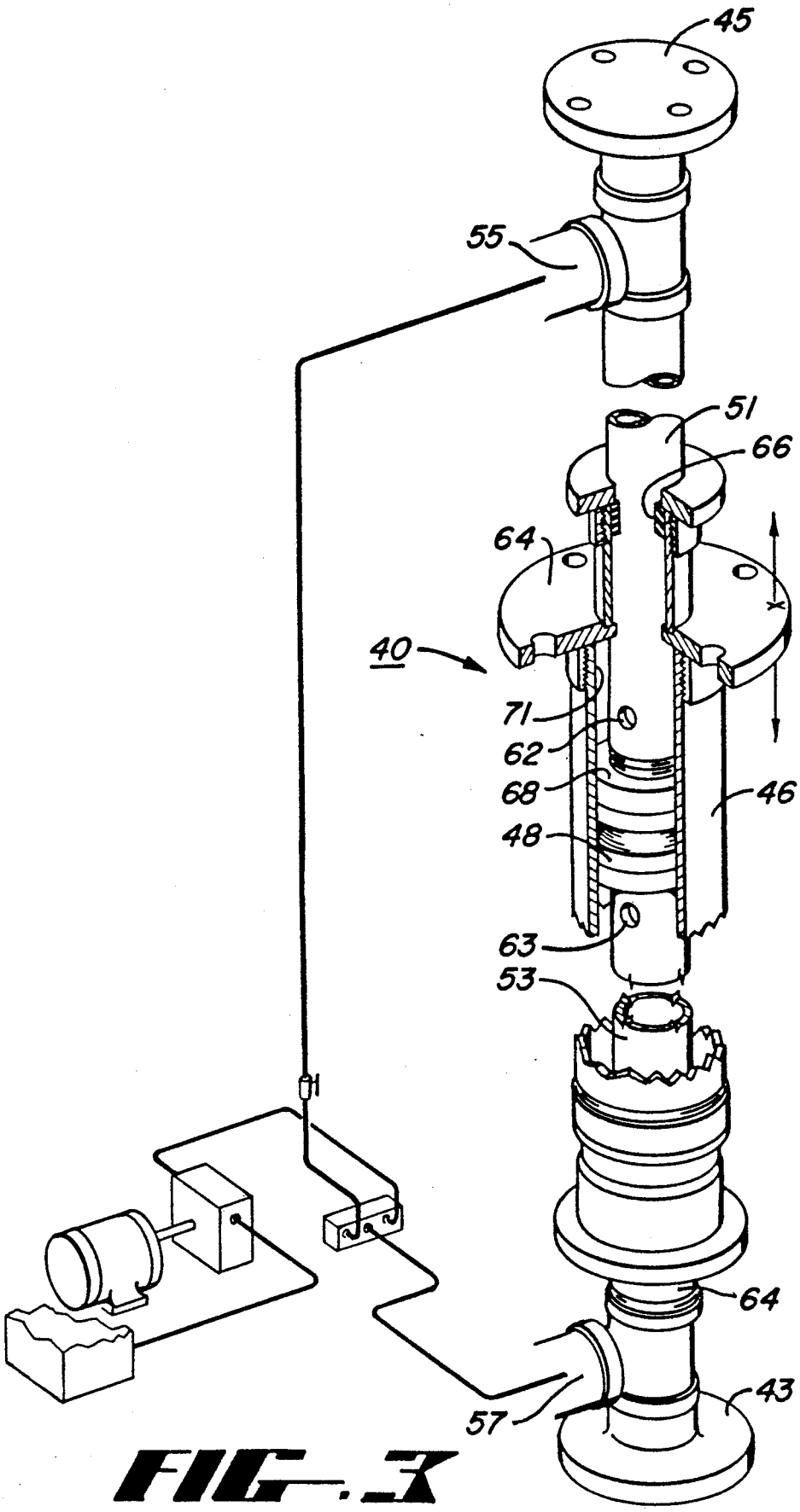
FIG. 3 illustrates the fluid motor of the present invention, partially cut away in order to permit clear understanding of the particular internal construction and association of parts.

In keeping with yet another aspect of the invention, the pumping unit 10 provides for a smooth and efficient source of motive power in the form of a hydraulic motor 40, which is illustrated in some considerable detail on FIG. 3. As best seen in FIG. 1, the hydraulic motor 40 is vertically disposed in a central location between the upwardly extending frame members 16. It is mounted on a lower support member 42 of the base 14, by a flanged cap 43, and is secured at the top of the tower by upper support member 44, to which flanged cap 45 attaches.

The hydraulic motor 40 of the present invention, unlike more conventional reciprocating pistons with connecting rods which flex and bend, is constructed with an elongated cylinder, or barrel, 46 which reciprocates against a stationary piston assembly 48. By employing this novel construction, stress and flexion normally associated with a long stroke of the hydraulic motor is dramatically reduced, making the motor more efficient, and of lessor sized than might be required to accomplish the same work with more conventional systems.

The motor 40 includes an upper cylindrical section 51 and a lower cylindrical section 53, which are interconnected at the piston assembly 48, having a diameter greater than that of the cylindrical sections 51 and 53. The piston assembly has transverse walls which serve as reaction members, as will be seen hereinafter. Hydraulic fluid under pressure is introduced, and, likewise, relieved from the interior of the upper and lower cylindrical sections through ports 55 and 57, respectively. As will be seen in FIG. 1, fluid is stored in a reservoir R until pumped by a pump P, operated by a motor M, into a control system, including a distributor block 60, where it is distributed either to the upper section or the lower section, as determined by the position of the counterweight apparatus. The control system is similar in construction to the one illustrated in my U.S. Pat. No. 4,242,057, and may be precisely controlled to provide the desired frequency and timing of the stroke. Any suitable means, including, but not limited to, mechanical, electrical, or fluid limit switches, not specifically illustrated, can be employed to determine the arrival of the counterweight apparatus at its upper and lower limit, or its position at any point in time, thus permitting control of the length of the stroke of the motor.

As may be seen in FIG. 1, the barrel 46 of the fluid motor 40 may be formed, or otherwise engaged or connected with, or to, the counterweight apparatus 30. Accordingly, with the counterweight apparatus in a position such as seen in FIG. 1, when fluid, under pressure, is injected through port 55, it travels downwardly, inside the upper cylindrical section 51 and through an injection port 62. As seen in FIG. 3, the barrel 46 is capped at both ends by end cap 64, which, by means of a flexible seal 66, effects a lubricated seal between the outside diametral wall of the upper section 51 and the flexible seal 66. The same construction, of course, is found on the lower end cap.

Accordingly, a pressure chamber is formed between the inside diametral wall of the barrel 46 and the outside diametral wall of upper and lower cylindrical sections 51 and 53. The chamber definition is completed by the inner surface 68 of the piston assembly 48 and the inner facing transverse wall 71 of the end cap 64. Thus, as fluid under pressure is injected through port 62, it fills the chamber, exerting pressure on the surface 71, causing the barrel, and thus, the counterweight apparatus, to move upwardly. Similarly, fluid in the lower chamber, formed between the lower section 53 and the barrel is forced through injection port 63, and exists through port 57 back to the reservoir. It will be apparent that due to the substantially identical structure in the upper and lower portions of the fluid motor, that when fluid under pressure is introduced through port 57, it will cause the barrel 46, and thus the counterweight apparatus 30, to be pulled downwardly within the tower.

Figure 2:
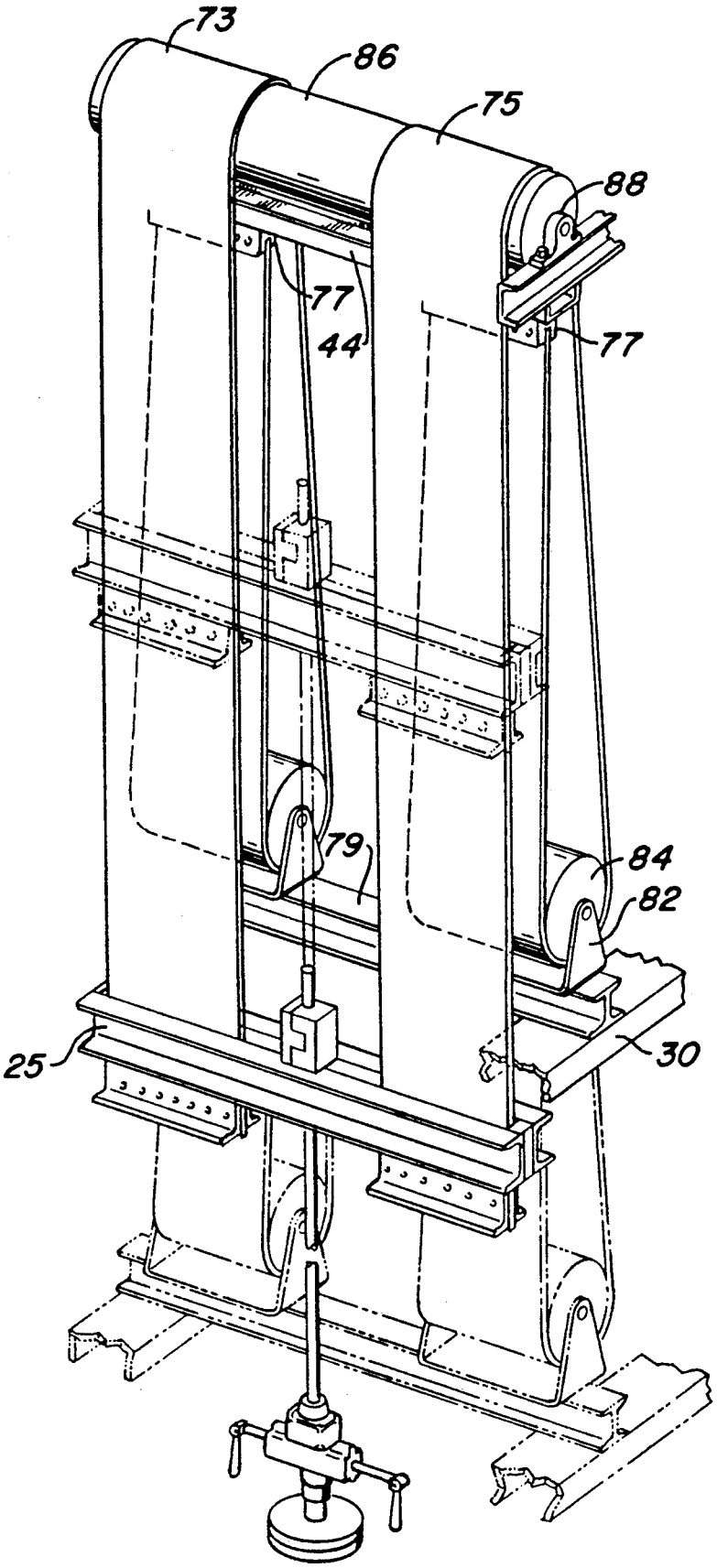
FIG. 2 is a partial frontal view illustrating the configuration of the elastic belt system.

In order to translate movement of the counterweight apparatus into reciprocating movement of the polish rod 21, the system contemplates the use of flexible belts 73 and 75, respectively. As seen in FIG. 2, belts 73 and 75 are secured, at one end, by means of clamping devices 77 mounted to the upper support cross member 44.

Another cross member, such as an I-beam 79, parallel to the upper support member 44, is secured to the top of the counterweight apparatus 30, and mounted thereto are a series of parallel pillow blocks 82, which receive a pair of rollers 84, disposed in coaxial array attached to the counterweight and assembly. At the top of the tower, a drum 86 is mounted in pillow blocks 88 for rotation on an axis parallel to the axes of the rollers 84.

As illustrated in FIG. 2, the belts 73 and 75 extend downwardly from their secured end, where they are looped about the rollers 84, after which they extend upwardly and over the drum 86 so that their other free end may be clamped or otherwise secured to the polish rod carrier 25.

Having thus, by means of a somewhat resilient belt material, interconnected the fluid motor and the polish rod, operation of the novel deep pumping unit of the present invention will be come apparent. With the counterweight apparatus at its lower limit within the tower, fluid under pressure is injected into port 55, causing upward movement of the counterweight apparatus, which, in turn, causes the polish rod to be lowered in the well. On the pumping stroke, fluid under pressure is injected through port 57, while fluid in the upper section is relieved through port 55, causing the counterweight assembly to be pulled downwardly towards the bottom of the tower, while the fluid motor receives an assist by virtue of the energy stored in the counterweight assembly as it was raised, the pumping stroke which causes the polish rod to be pulled upwardly requires the greater energy to achieve. However, by using the belt configuration of the present invention, a mechanical advantage is enjoyed, which alleviates the amount of pressure required to accomplish the stroke. Also, it will be seen that an incremental movement of the counterweight apparatus results in twice the movement of the polish rod. Thus, both the speed and stroke with which the motor provides reciprocal movement can be slowed down, by decreasing the volume of the pump P and the length of the stroke can be adjusted by the control system delivering the same volume of crude. An ancillary benefit is also derived in that slower movement of the hydraulic motor translates into lower inertial forces on the system upon directional reverses, which, of course, means less shock at the time of reversal on the polish rod and other elements of the system.

It will also be seen that the length of the stroke is not limited by the length of the piston connecting rod as in more conventional constructions. Instead, the counterweight assembly is capable of travelling virtually the entire length of the upper and lower sections, permitting a stroke of up to 30 feet. Accordingly, the fluid motor may travel more slowly, while accomplishing the same work, and use of the fluid motor in cooperation with the belt system, shock absorption is achieved which minimizes stress on the polish rod at the top and bottom of the stroke of the fluid motor where reversal of direction takes place.

Having thus described a preferred embodiment of my invention, I claim the following:

1. In a long stroke pumping unit for deep wells, of the type having a tower disposed adjacent to, and immediately above, a well, and having a polish rod extending from the tower into the well, and the tower having a base from which spaced, vertically disposed frame members extend, the frame members being tied together in rigid connection by space cross members, the improvement comprising:

means defining a vertically disposed, reciprocating fluid motor, said motor being mounted at one end thereof to said base of said tower, and the opposite end thereof to the top of the tower, means defining counterweight apparatus disposed within said frame, and affixed directly to said fluid motor for reciprocation therein, drum means mounted to the top of said tower, for rotation about a horizontal axis, belt means said belt means being disposed about said drum and interconnecting said counterbalance apparatus and said polish rod, pump means for developing and sequentially delivering fluid to opposite ends of said motor, so as to cause said motor, and counterweight apparatus to reciprocate, and control valve means, responsive to the position of said counterweight apparatus, disposed between said pump and said motor, for selectively directing fluid from said pump to said motor so as to pull said counterweight apparatus upwardly, and then downwardly in a reciprocating movement, which movement is transmitted through said belts to reciprocate said polish rod.

2. The device as set forth in claim 1, wherein, said fluid motor comprises a fixed, elongated cylinder, said cylinder having an upper section, a lower section, said upper and lower sections being of substantially equal length, a center section of greater diameter that said upper and lower sections, said center section defining a fixed piston disposed between, and interconnecting said upper and lower sections;

means defining a barrel secured to said counterweight apparatus, said barrel being fitted over said elongated cylinder, and having an internal diameter slightly greater than the outside diameter of said piston; means defining end caps at opposite ends of said barrel for sealing each said barrel end against the escape of fluid; each of said upper and lower sections of said cylinder being formed with an orifice defining a fluid port proximate to said piston, control means includes a distributor valve; means providing a fluid connection between said distributor valve and the interior of each of said upper and lower sections, so that when fluid under pressure is directed into one of said section, said fluid reacts against said piston and pushes against said end cap to pull the counterweight apparatus in an upward or downward direction.

3. Apparatus as set forth in claim 1 wherein, said counterweight apparatus includes an enclosure, said enclosure adapted to receive high density particulate matter.

4. Apparatus as set forth in claim 1 wherein, said counterweight apparatus includes a cage adapted to receive and hold in secure relation, high density weight.

5. Apparatus as set forth in claim 1 wherein, each increment of movement of said counterweight apparatus results in corresponding movement of said polish rod equal to twice the movement of said counterbalance apparatus.

6. Apparatus as set forth in claim 1, wherein, said counterweight apparatus includes a plurality of spaced apart rollers mounted to the top thereof, said rollers having a common axis of rotation, and said axis of rotation being parallel to the axis of rotation of said drum, and said rollers being aligned with said drum, belt means having an end thereof affixed to the top of said tower, and extending downwardly about said rollers, and thereafter upwardly and over said drum means, so that the opposite end thereof is attached to said polish rod.

7. Apparatus as set forth in claim 2, wherein, said counterweight apparatus includes a plurality of spaced apart rollers mounted to the top thereof, said rollers having a common axis of rotation, and said axis of rotation being parallel to the axis of rotation of said drum, and said rollers being aligned with said drum, belt means having an end thereof affixed to the top of said tower, and extending downwardly about said rollers, and thereafter upwardly and over said drum means, so that the opposite end thereof is attached to said polish rod, whereby each increment of movement of said counterweight apparatus results in corresponding movement of said polish rod equal to twice the movement of the counterbalance apparatus.

* * * * *